US007600336B2

(12) United States Patent
Hermanson et al.

(10) Patent No.: US 7,600,336 B2
(45) Date of Patent: Oct. 13, 2009

(54) SOUND DEVICE FOR ENHANCING GIFT PACKAGES, AND METHOD AND SYSTEM FOR MARKETING SUCH DEVICE

(75) Inventors: Terry Hermanson, New York, NY (US); Huang Meng-Suen, Kowloon (HK)

(73) Assignee: Mr. Christmas Incorporated, New York, NY (US)

( * ) Notice: Subject to any disclaimer, the term of this patent is extended or adjusted under 35 U.S.C. 154(b) by 104 days.

(21) Appl. No.: 10/930,819

(22) Filed: Sep. 1, 2004

(65) Prior Publication Data

US 2006/0042135 A1 Mar. 2, 2006

(51) Int. Cl.
*G09F 27/00* (2006.01)

(52) U.S. Cl. ..... 40/455; 40/427

(58) Field of Classification Search ..... 40/124.03, 40/455, 427; 446/297, 397; 84/3; 232/36; 116/100; 340/568.1, 571
See application file for complete search history.

(56) References Cited

U.S. PATENT DOCUMENTS

| | | | | | |
|---|---|---|---|---|---|
| 2,487,138 | A | | 11/1949 | Howe | 84/95 |
| 3,594,937 | A | * | 7/1971 | Luchsinger | 40/124.03 |
| 3,798,806 | A | * | 3/1974 | Sanford | 40/124.03 |
| 4,542,676 | A | | 9/1985 | Carlson et al. | 84/94 |
| 4,920,674 | A | * | 5/1990 | Shaeffer | 40/412 |
| 5,056,660 | A | | 10/1991 | Huang | 206/232 |
| 5,063,698 | A | * | 11/1991 | Johnson et al. | 40/124.03 |
| 5,275,285 | A | * | 1/1994 | Clegg | 206/449 |
| 5,387,108 | A | * | 2/1995 | Crowell | 434/319 |
| 5,433,035 | A | * | 7/1995 | Bauer | 40/124.03 |
| 5,444,767 | A | * | 8/1995 | Goetcheus et al. | 379/67.1 |
| 5,778,574 | A | * | 7/1998 | Reuben | 40/124.03 |
| 5,860,065 | A | * | 1/1999 | Hsu | 704/270 |
| 5,973,250 | A | | 10/1999 | Zirille et al. | 84/600 |
| 6,028,752 | A | * | 2/2000 | Chomette et al. | 360/137 |
| 6,104,306 | A | * | 8/2000 | Hogue et al. | 340/686.1 |
| 6,253,183 | B1 | * | 6/2001 | Boucard | 704/272 |
| 6,282,819 | B1 | * | 9/2001 | Gu | 40/124.03 |
| 6,288,319 | B1 | * | 9/2001 | Catona | 84/609 |
| 6,523,285 | B1 | * | 2/2003 | Gilson et al. | 40/124.03 |
| 6,591,523 | B2 | * | 7/2003 | Pines | 40/124.03 |
| 6,675,511 | B2 | * | 1/2004 | Pines | 40/124.03 |
| 6,757,393 | B1 | * | 6/2004 | Spitzer et al. | 381/77 |

(Continued)

*Primary Examiner*—William L. Miller
(74) *Attorney, Agent, or Firm*—Fitzpatrick, Cella, Harper & Scinto

(57) ABSTRACT

A sound device includes a sound module including a switch electrically connected to the sound module such that when the switch is "on" the sound module produces a sound and when the switch is "off" the sound module is silent. The sound device also includes apparatus for securing the sound module to a gift container or package, a switch actuator such as an elongated strip adapted to toggle the switch "off" to "on", the elongated strip including an adhesive applied to a distal end of the elongated strip, and a housing that houses the sound module. The housing includes a slot through which the elongated strip extends such that the distal end of the elongated strip is disposed on the outside of the housing and a proximal end of the elongated strip, which is remote from the distal end, is disposed on the inside of the housing, and the elongated strip toggles the switch "off" to "on" by sliding out of the housing through the slot. Other configurations for toggling the switch are also disclosed.

12 Claims, 12 Drawing Sheets

U.S. PATENT DOCUMENTS 6,845,583 B2 * 1/2005 Lee ..... 40/717
6,862,824 B1 * 3/2005 Hermanson et al. ..... 40/427
6,930,600 B1 * 8/2005 Hsieh ..... 340/539.1
6,978,561 B1 * 12/2005 Hunter ..... 40/124.01
2002/0139017 A1 * 10/2002 Pines ..... 40/124.03
2002/0152652 A1 * 10/2002 Pines ..... 40/124.03
2004/0111930 A1 * 6/2004 Ossmann ..... 40/124.14
2004/0237359 A1 * 12/2004 Lee ..... 40/124.03

* cited by examiner

SOUND DEVICE FOR ENHANCING GIFT PACKAGES, AND METHOD AND SYSTEM FOR MARKETING SUCH DEVICE

BACKGROUND OF THE INVENTION

1. Field of the Invention

The present invention is directed to a sound device for enhancing gift containers or packages, such as by providing sound when the gift container is opened. The invention also is directed to a system and method for marketing such a device.

2. Related Art

People enjoy celebrating by having a party and giving gifts. Often such celebrations are brought on by a significant event—such as a wedding or a child birth—or by a holiday. The gifts, and even the packaging for the gifts, are often carefully chosen to provide the greatest pleasure to the person receiving the gift and also to lend an even more festive atmosphere to the celebration. The gift is often wrapped in festive paper, adorned with a ribbon, and accompanied by a card.

In an effort to enliven gift packaging, some gift cards will play a tune when opened. A conventional, electronic sound module used in such gift cards is shown in FIG. 16. The conventional sound module comprises batteries 1001 powering an integrated circuit 1000 and a speaker 1010. Power is supplied or interrupted to the integrated circuit 1000 by way of a switch 1020, which comprises a pair of contacts. One contact is in the form of a flexible, conductive leaf 1022 and the other is in the form of a conductive plate (not shown). Disposed between the conductive leaf 1022 and the conductive plate is one end of an insulating tongue 1024. The other end of the tongue 1024 protrudes from the sound module in cantilever fashion. The tongue 1024 can be moved along arrow A, parallel to its axis, so that a greater or lesser extent of the tongue 1024 is disposed on the outside of the sound module.

When the tongue 1024 is disposed substantially within the sound module, the tongue is interposed between the leaf 1022 and the plate, preventing contact. With the tongue 1024 in this position, the switch is off, no power is supplied to the integrated circuit, and the sound module is silent. When the tongue 1024 is disposed substantially on the outside of the sound module, the leaf 1022 and the plate are in contact and power is supplied to the integrated circuit 1000. The integrated circuit 1000 then provides current to the speaker 1010 to drive the speaker 1010 and produce a tune or other sound.

In a conventional, tune-playing gift card, the sound module shown in FIG. 16 is adhered to one flap of the card, in some cases behind a decorative flap. The tongue extends across the crease of the card and is adhered to the opposite flap. This relative disposition of the tongue and the sound module causes the tongue to be moved away from the sound module when the card is opened, permitting the leaf and the plate to come in contact. As a result, a tune is played. When the card is closed, the tongue is interposed between the leaf and the plate and the tune ceases.

Although the conventional, music-playing card enlivens a typical gift card, it does not help a consumer that likes the idea of playing a tune but does not want to have a tune played in a card or that does not like the music-playing cards available. Therefore, there is a need in the art for a generic sound module. That is, there is a need for a sound module that can be packaged and marketed by itself and that can be used with any consumer gift package or container. Moreover, there is a need for a system and method by which a plurality of such devices can be marketed so that the consumer can choose any one of the plurality of devices to use with a particular gift container.

SUMMARY OF THE INVENTION

According to one aspect of the invention, a device for producing sound is configured to be selectably mounted by a user on a package having first and second portions movable relative to each other from a closed position to an open position. The device includes a power source; a sound module adapted to produce sound when electrically connected to said power source; means permitting the user to mount said sound module on said first portion of said package; a switch electrically interposed between said sound module and said power source configured to move from a non-conducting position in which said power source is not electrically connected to said sound module and a conducting position in which said power source is electrically connected to said sound module; a switch activator linked to said switch to move it from the non-conducting position to the conducting position; and means permitting said user to attach said switch actuator to said second portion of said package, said switch actuator and said attaching means being configured such that when said first and second portions of said package are moved from the closed to the open position said switch moves from its non-conductive to its conducting position, thereby to connect said power source to said sound module and cause said sound module to produce sound.

In accordance with another aspect, the present invention is a method of simultaneously marketing a plurality of sound devices of the type described above. The method includes amalgamating a plurality of such devices together, placing the amalgamated plurality of devices in a container and offering the container with the plurality of devices therein for sale.

In still another aspect, the invention is a system for simultaneously marketing a plurality of sounds devices of the type describe above. The system includes a container large enough to contain the plurality of devices and means or offering the container with the plurality of devices for sale.

According to yet another aspect of the invention, a sound device includes a sound module including a switch electrically connected to the sound module such that when the switch is "on" the sound module produces a sound and when the switch is "off" the sound module is silent. The sound device also includes means for securing the sound module to a gift container, an elongated strip adapted to toggle the switch from the "off" position to the "on" position, with the elongated strip including an adhesive applied to a distal end of the elongated strip, and a housing that houses the sound module. The housing includes a slot through which the elongated strip extends such that the distal end of the elongated strip is disposed on the outside of the housing and a proximal end of the elongated strip, which is opposite to the distal end, is disposed on the inside of the housing, and the elongated strip toggles the switch "off" to "on" by sliding out of the housing through the slot.

According to still another aspect of the invention, a sound-enhanced gift package comprises a gift container including a first member and a second member, with the first and second members adapted to be moved from a close relationship to a separated relationship, means for securing the sound module to one of the first member and the second member of the gift container, a sound module including a speaker, an integrated circuit electrically connected to the speaker, a power source and a switch electrically connected to the integrated circuit, and a housing that houses the speaker, the integrated circuit and the power source. The switch is "off" when the first and second members are in the closed relationship and is "on" when the first and second members are in the separated relationship.

According to yet another aspect of the invention, a package comprises a blister or clam shell container having generally a bowl shape with an open end, a plurality of sound modules disposed within the container, with each sound module comprising means for securing the sound module to a gift container and a switch electrically connected to the sound module such that when the switch is "on" the sound module produces a sound and when the switch is "off" the sound module is silent, and a backing positioned over the open end of the container.

DETAILED DESCRIPTION OF THE PREFERRED EMBODIMENTS

Figure 16:
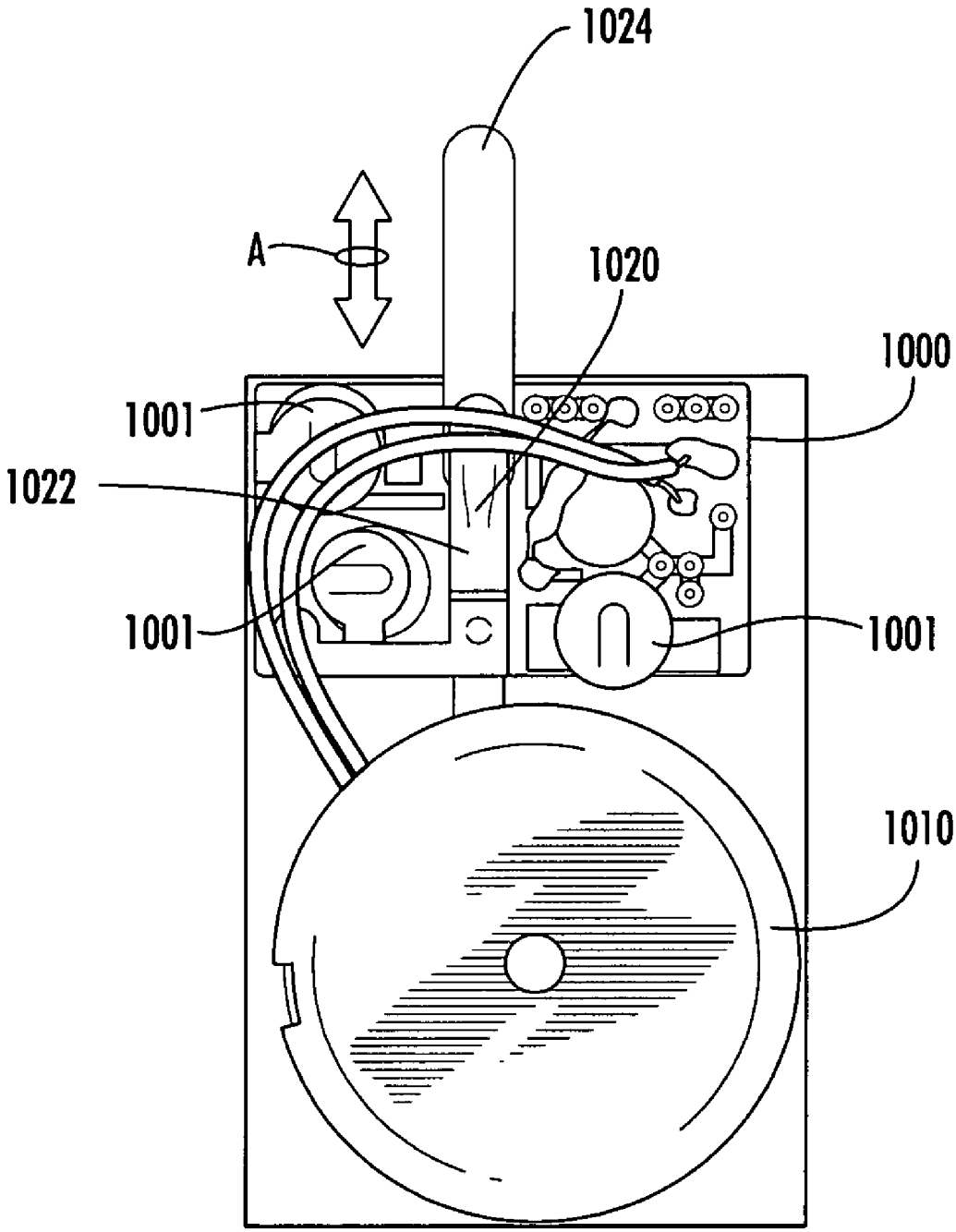
FIG. 16 (PRIOR ART)
FIG. 16 shows a plan view of a conventional sound module as noted earlier.

The present invention provides an improvement in the design of a conventional sound module, such as the sound module shown in FIG. 16. The thus-improved sound module 10 in accordance with the present invention can be placed on the inside of any gift package, container or card. The improved module will then play a sound when, for example, a lid is removed from a gift box.

Figure 1:
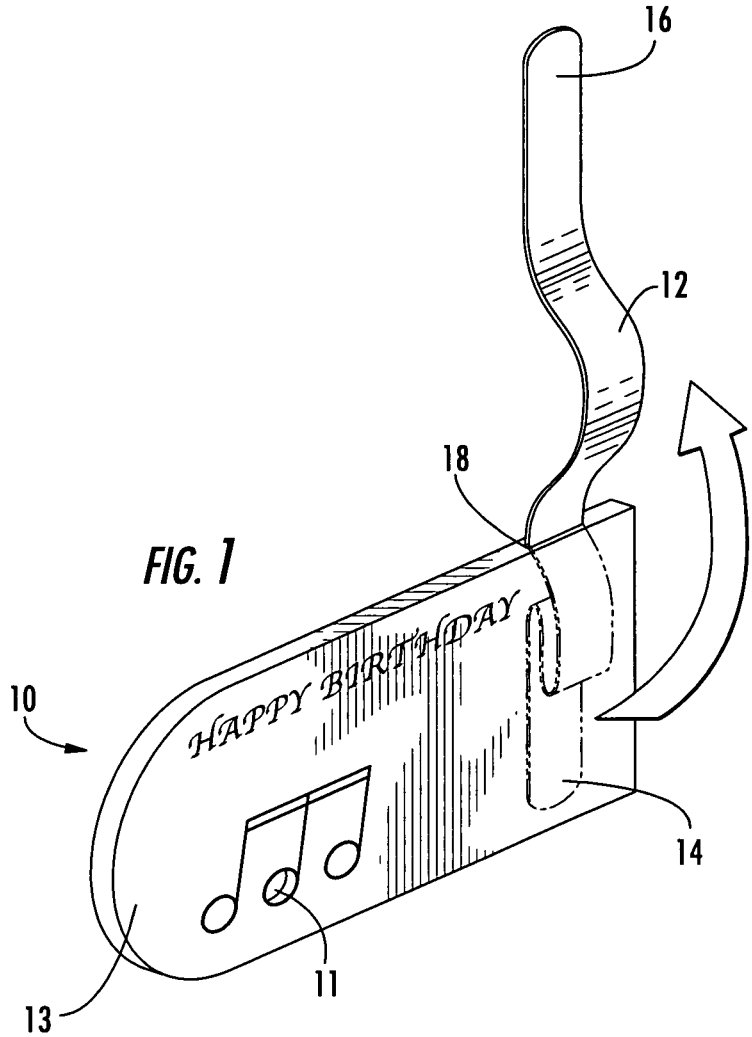
FIG. 1 shows a perspective view of a sound device according to a first embodiment of the present invention.

As shown in FIG. 1, a housing 13 for the sound device 10 houses various components of the sound module, such as the speaker, integrated circuit and power source or batteries (as is shown in FIG. 16), among other things. The housing 13 may be composed of any one of a plurality of materials, including plastic, and may be transparent or colored, and may include text, decoration, characters, figures, scenes or the like. The housing 13 preferably includes an aperture 11 that coincides in position with the opening of the speaker (such as is shown in FIG. 16). The back of the housing is also provided with an adhesive 15 (shown in FIGS. 4 and 5) or other means for securing it to a surface as will be described in greater detail below.

Also shown in FIG. 1, the sound device 10 according to the present invention includes an elongated insulating strip 12, one proximal end 14 of which is disposed within the housing 13 and another, distal end 16 of which is disposed on the outside of the housing 13. The proximal end 14 of the strip 12 on the inside of the housing 13 is interposed between the leaf and the backing plate that compose the switch (see FIG. 16), thus preventing the leaf and the backing plate from contacting each other and completing a circuit.

The proximal end 14 of the strip 12 inside the housing 13 may be folded over on itself several times in order to make the sound module 10 and the strip 12 more compact while providing an appropriate length for the strip 12. An outer portion of the strip 12 extends through a slot 18 in the housing 13 and terminates in the distal end 16. The distal end 16 may be folded down alongside the housing and adhered to the housing 13 in order to prevent it from flapping loosely, although such folding and adhering is not necessary.

Figure 2:
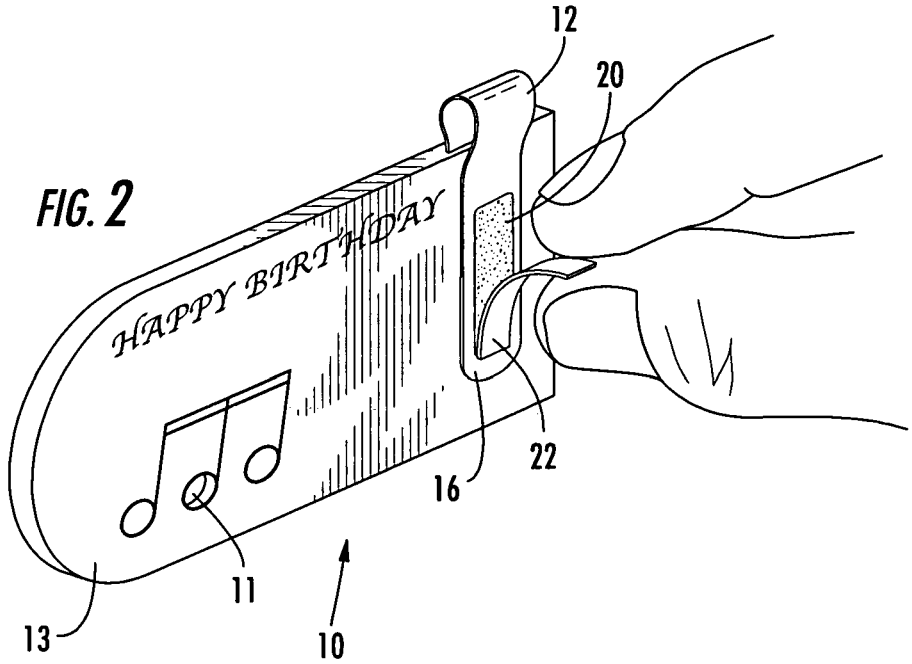
FIG. 2 shows a perspective view of a number of sound devices according to the first embodiment as a peelable strip is being removed from one of them.
Figure 3:
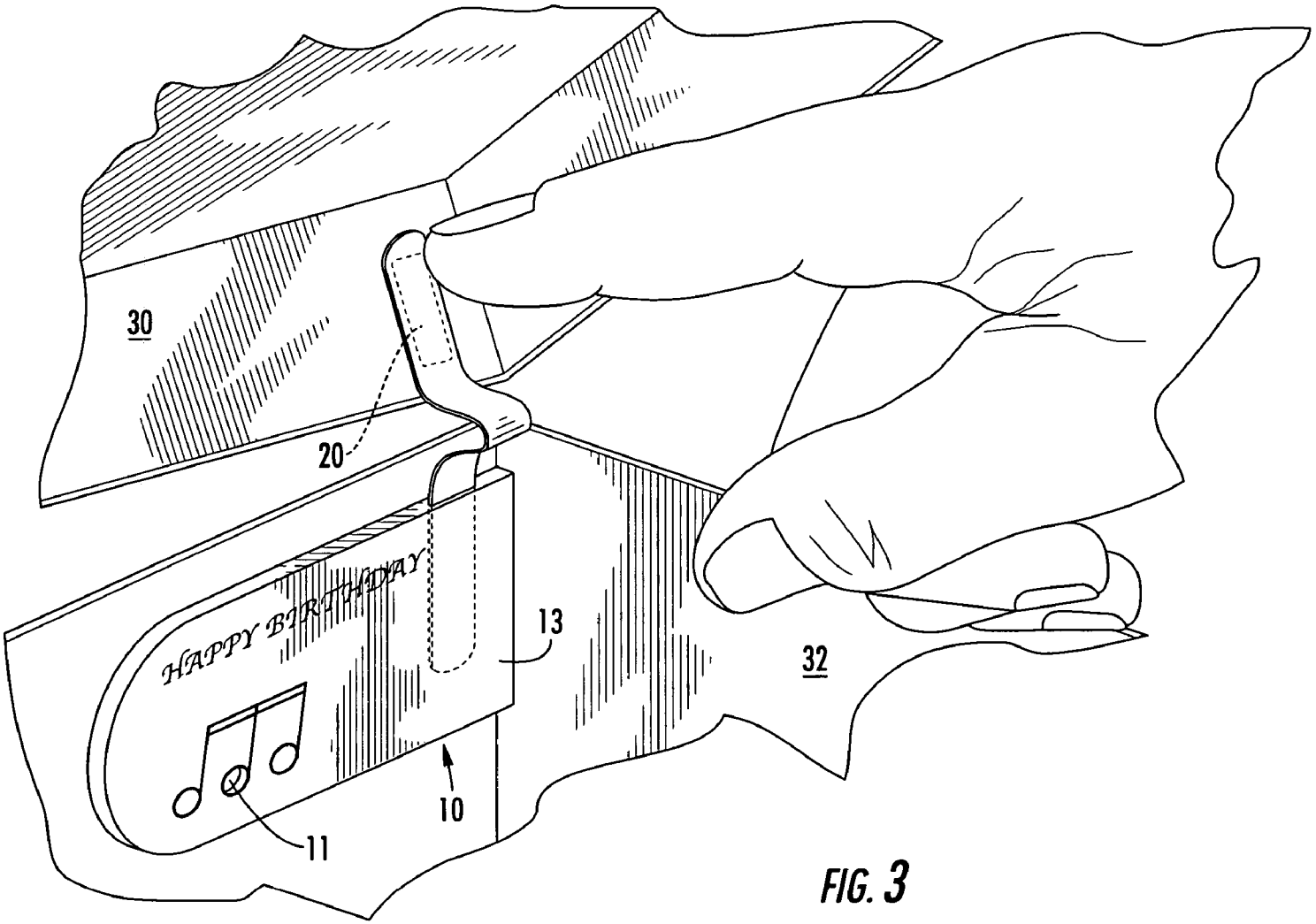
FIG. 3 shows the sound device according to the first embodiment being applied to a gift box.

As shown in FIGS. 2 and 3, the distal end 16 of the strip 12 preferably includes an adhesive 20. The strip 12 may then be adhered to a surface, such as the inside of a portion of a gift container, like a gift box lid 30, as shown in FIG. 3. The adhesive 20 may be of any suitable type and may provide a permanent, semi-permanent or temporary attachment to the gift box lid 30. Preferably, the adhesive 20 is covered by a peelable panel 22 prior to use, as shown in FIG. 2. The adhesive 20 and peelable panel 22 are preferably disposed on a side of the strip 12 that faces away from the housing 13, as shown in FIG. 2, although the adhesive 20 and peelable panel 22 may alternatively be provided on the side of the strip 12 that faces the housing 13.

Although the means for securing the distal end of the strip to the gift box or gift box lid has been described as an adhesive, other means may be used. For example, the distal end may be secured using hook and loop fasteners, staples, clips and the like.

Figure 7:
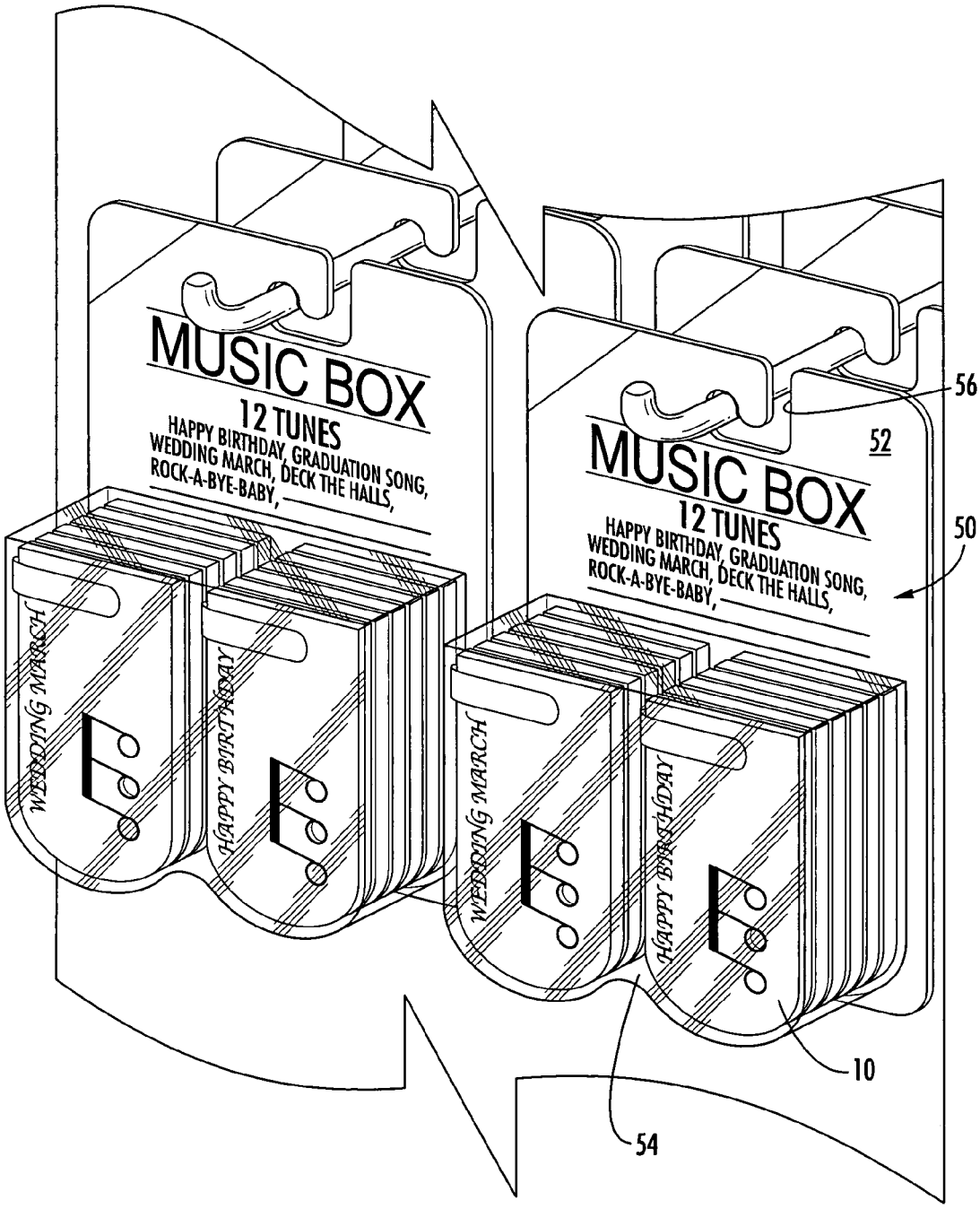
FIG. 7 shows a container or package containing a plurality of sound devices for marketing those devices in accordance with the invention.

As further shown in FIGS. 2 and 7, a plurality of the sound device 10 according to the present invention may be packaged as an amalgamated unit for sale. The package 50 may be a clam shell or blister pack type and, for example, comprises a backing 52 having text, images or both printed on it and a blister pack or cover 54 affixed to the backing 52. The blister pack 54 is preferably transparent and shaped to contain the plurality of sound devices 10. Any number of sound devices may be contained in the blister pack 54, although twelve such devices are shown in FIG. 7. Moreover, the blister pack 54 may be translucent or opaque instead of transparent. The blister pack 54 is preferably plastic, and the backing 50 may be composed of paper or plastic. The backing 50 preferably includes a slot 56 enabling the package 50 to be hung on a hook to be displayed in a manner commonly found in retail stores.

The package 50 shown in FIG. 7 may contain the plurality of sound devices 10, all of which play the same tune or each one of which plays a tune different from every other device 10 in the package 50. Thus, one sound device 10 may play the tune "Happy Birthday" while another devices 10 may play the "Wedding March". Alternatively, two or more sound devices 10 in the package 50 may play the same tune. Thus, a single package 50 can contain sound devices 10 appropriate for a plurality of different occasions such as a graduation, a birthday, a wedding, a child birth, Christmas, a bar mitzvah, Kwanzaa, etc. Besides playing tunes, the sound device can produce other sounds, such as the sound of people clapping, animal sounds, etc.

To use the device module according to the invention, a user selects a device 10 from a package 50 as shown in FIG. 7 that plays an appropriate tune and removes it from the package 50. The user then peels off the panel 22 covering the adhesive 20 on the distal end 16 of the elongated strip 12, as shown in FIG. 2. As shown in FIG. 1, the elongated strip 12 may be pulled by the user slightly out of the housing 13 of the device 10, although it is not necessary to do so.

Subsequently, as shown in FIG. 3, the user affixes the housing 13 to the inside of, for example, a gift box or box body 32 by way of adhesive 15 or other securing means provided on the back of the housing 13. (As noted, other alternative securing means may include hook and loop fasteners, pins, staples, clips and rivets.)

Figure 4:
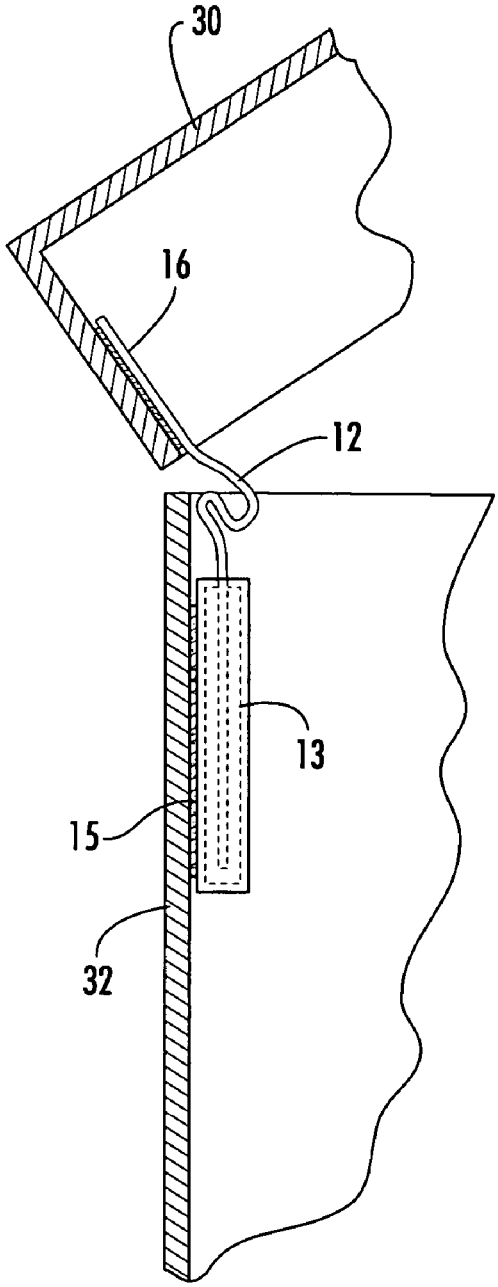
FIGS. 4 and 5 show vertical cross-sectional views of the sound module applied to a gift box body and a gift box lid.
Figure 5:
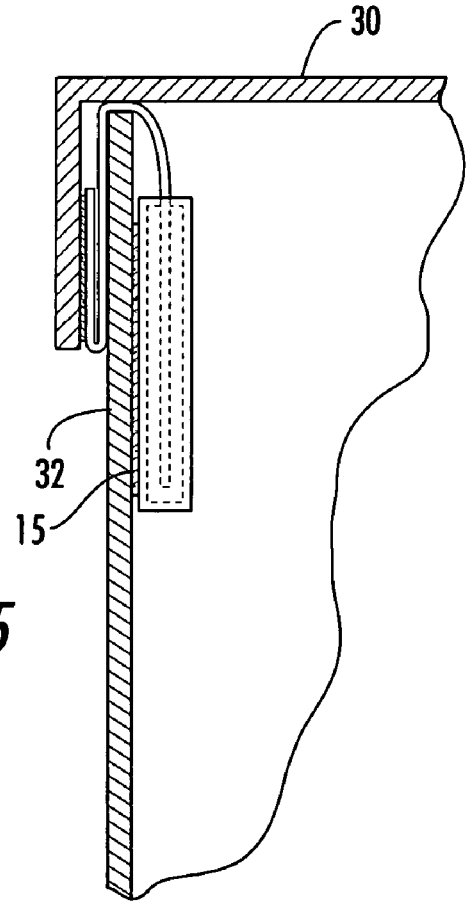

Once the housing 13 has been affixed to the inside of the gift box 32 as shown in FIG. 3, the distal end 16 of the elongated strip 12 is applied to the inside of the gift box lid 30. As can be seen in FIGS. 4 and 5, the elongated strip 12 is preferably long enough to allow the user to place the distal end 16 on the gift box lid 30 and to then place the lid 30 on the gift box 32. The distal end 16 may be placed on a depending sidewall of the lid 30, as shown in FIGS. 4 and 5, or the distal end 16 may be placed on the horizontal portion of the lid 30.

In fact, the precise placement of the distal end is not essential to the invention, provided one end of the strip is on one of the gift box lid and the gift box and the other end of the elongated strip is disposed within the housing, which is attached to the other of the gift box and the gift box lid. In other words, the precise placement of the distal end is not important, as long as the strip is pulled out of the housing (as shown in FIG. 6 and discussed below) when the gift box and gift box lid are separated.

It should be noted that although installation of the invention has been described with respect to a particular order of steps, one of ordinary skill will appreciate that that order can be altered without affecting the spirit of the invention. For example, the panel 22 shown in FIG. 2 that covers the adhesive may be removed just prior to adhering the distal end 16 to the gift box lid 30. Also, the distal end 16 may be affixed to the gift box lid 30 before the housing 13 of the sound module 10 is attached to the gift box 32. Other variations are also conceivable.

Figure 6:
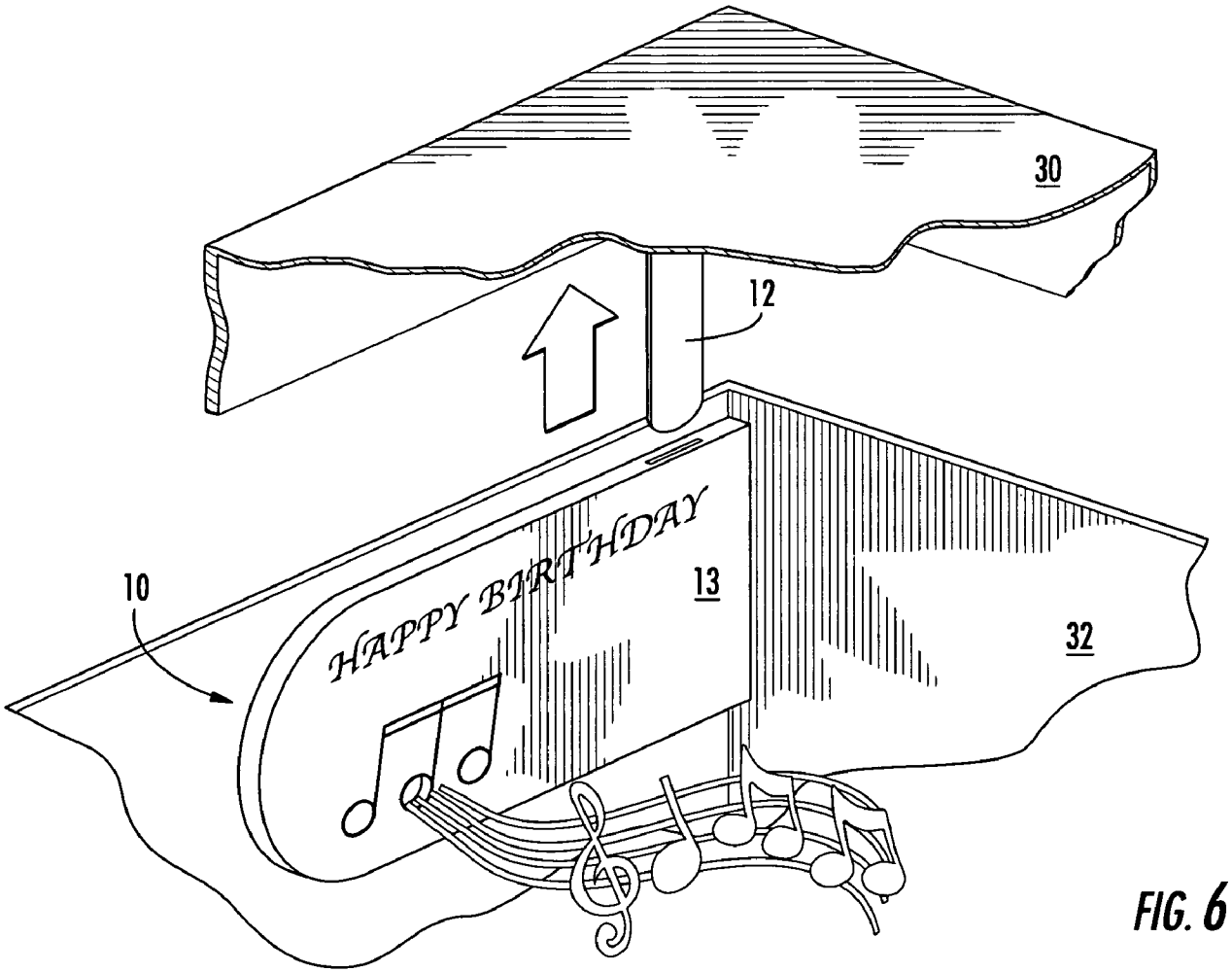
FIG. 6 shows a partial, perspective view of the sound device operating when the gift box lid is removed from the gift box.

At any rate, when the lid 30 is removed from the gift box 32, the elongated strip 12 is pulled out of the housing of the sound module 10, as shown in FIG. 6. This operation causes the leaf and backing plate of the switch (shown in FIG. 16) to be brought into electrical contact, thus providing power to the integrated circuit within the housing 13 and driving the speaker to produce a tune or other sound.

Figure 8:
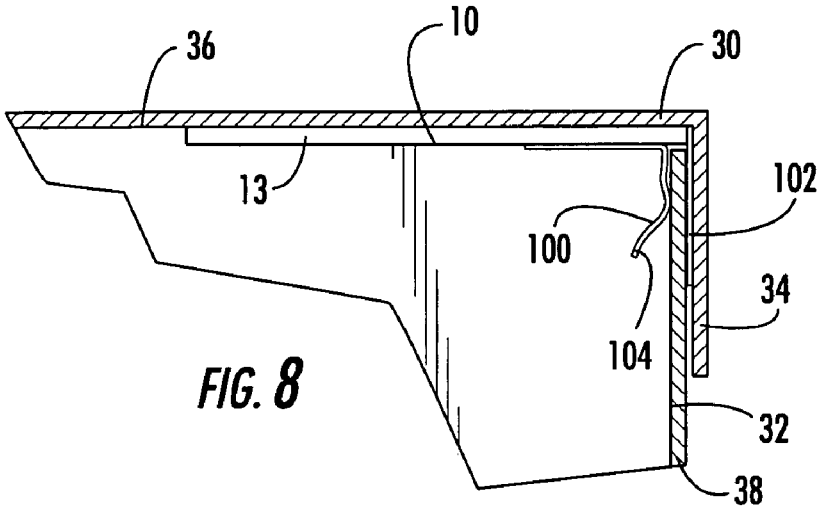
FIGS. 8 and 9 show partial, cross-sectional views of a sound device according to a second embodiment.
Figure 9:
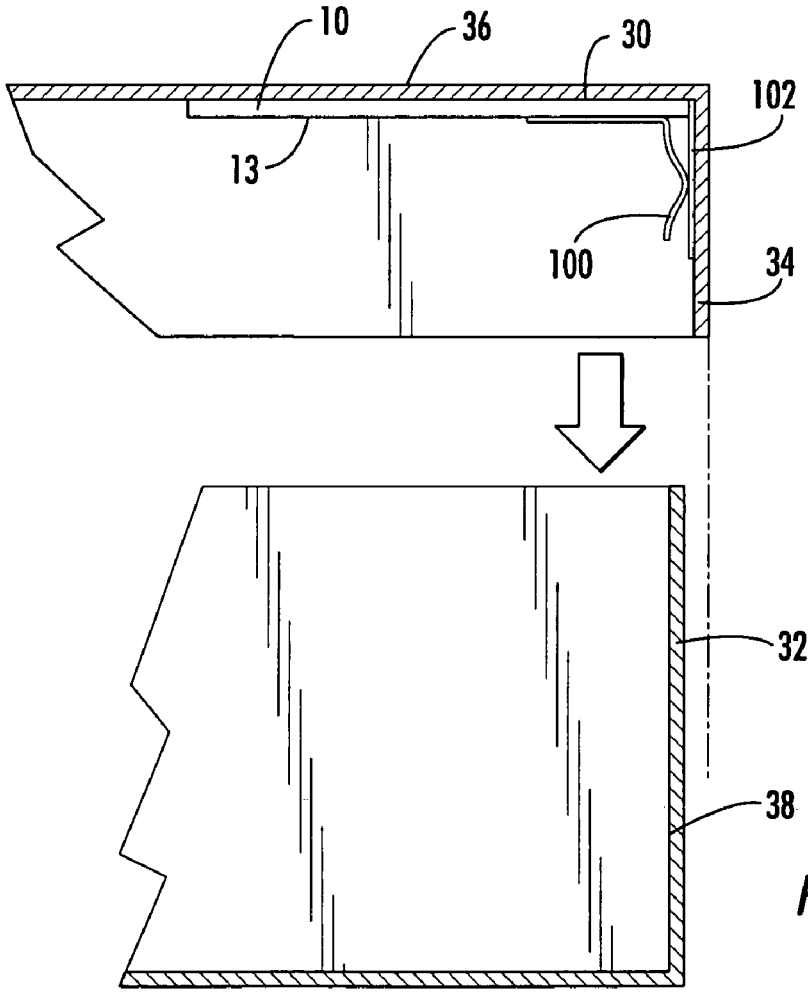

A second embodiment of the present invention is shown in FIGS. 8 and 9. The sound module 10 of this second embodiment is the same as that of the first, with the exception of the contacts composing the switch. As can be seen in those Figures, the conductive leaf 100 and backing plate 102 composing the switch are disposed on the outside of the housing 13 of the sound device module 10. The leaf 100 and plate 102 extend orthogonally from the housing 13 so that when the housing 13 of the sound module 10 is attached to a gift box lid 30, the switch components run parallel to a sidewall 34 of the gift box lid 30. Of course, as in the first embodiment, the sound device 10 may be attached to the gift box 32 instead of the gift box lid 30.

When the gift box lid 30 is placed on the gift box or box body 32 as shown in FIG. 8, a sidewall 38 of the gift box 32 is interposed between the leaf 100 and plate 102 of the switch. Therefore, no power is provided to the integrated circuit of the sound module 10 and no sound is produced. However, when the lid 30 is removed from the gift box 32, the leaf 100, which is biased toward the plate 102, contacts the plate 102 thereby energizing the integrated circuit to drive the speaker and produce a sound. Preferably, the leaf 100 includes an inclined lead-in portion 104, that facilitates interposing the sidewall 38 of the gift box 32 between the leaf 100 and the plate 102.

Although one of the components of the switch in the sound device 10 of the foregoing embodiments has been described as a leaf, one of ordinary skill will appreciate that other types of contacts may be used. For example, rather than a leaf, the contact may be a flexible wire or other conductive, biased member.

Figure 10:
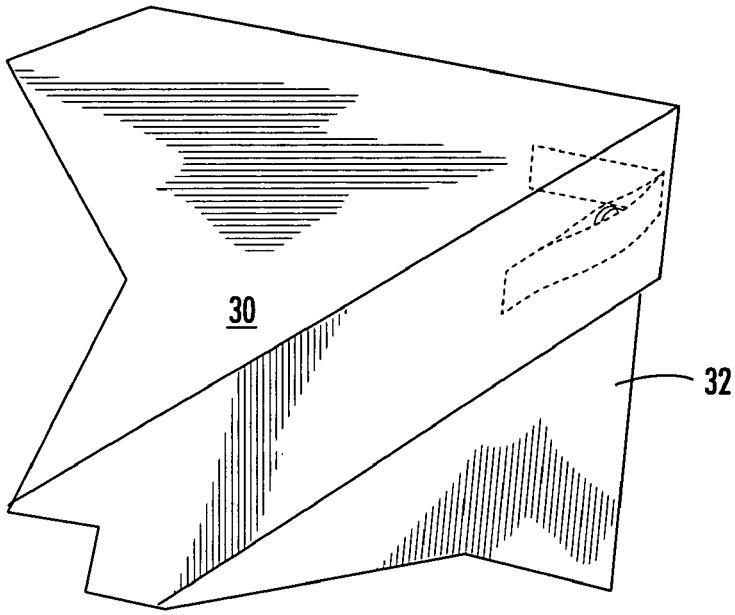
FIGS. 10 and 11 show perspective views of a switch for a sound device according to a third embodiment.
Figure 11:
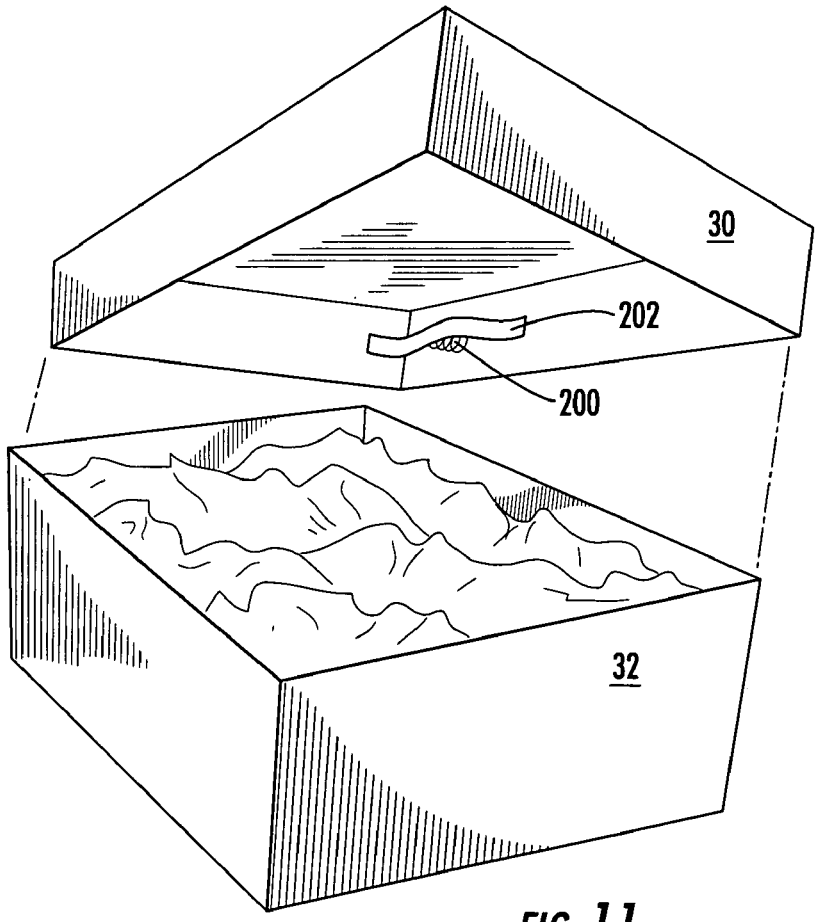

A third embodiment of the present invention, shown in FIGS. 10 and 11, comprises a coil spring 200 biasing a flexible strip 202. The flexible strip 202 may be composed of a conductive material in order to function as a leaf, similarly to the leaves of the first and second embodiments. In other words, the flexible strip 202 may contact a conductive backing plate on the sound module (not shown in FIGS. 10 and 11) when the lid 30 is removed from the gift box 32 and the spring 200 biases the strip 202 as shown in FIG. 11.

In the third embodiment, when the gift box lid 30 is placed on the gift box 32, the spring 200 is depressed and the sound device does not produce sound. As shown in FIG. 11, when the gift box lid 30 is removed, the spring 200 is released thereby to close the sound device switch so that the device can produce sound.

The sound device according to the first through third embodiments have been described in conjunction with a gift box and a gift box lid. However, other gift containers may be used with the sound modules according to the present invention. Such containers including gift bags (discussed below with respect to the fourth embodiment), envelopes, crates and cards (shown in FIGS. 13 through 15 and discussed below).

Figure 12:
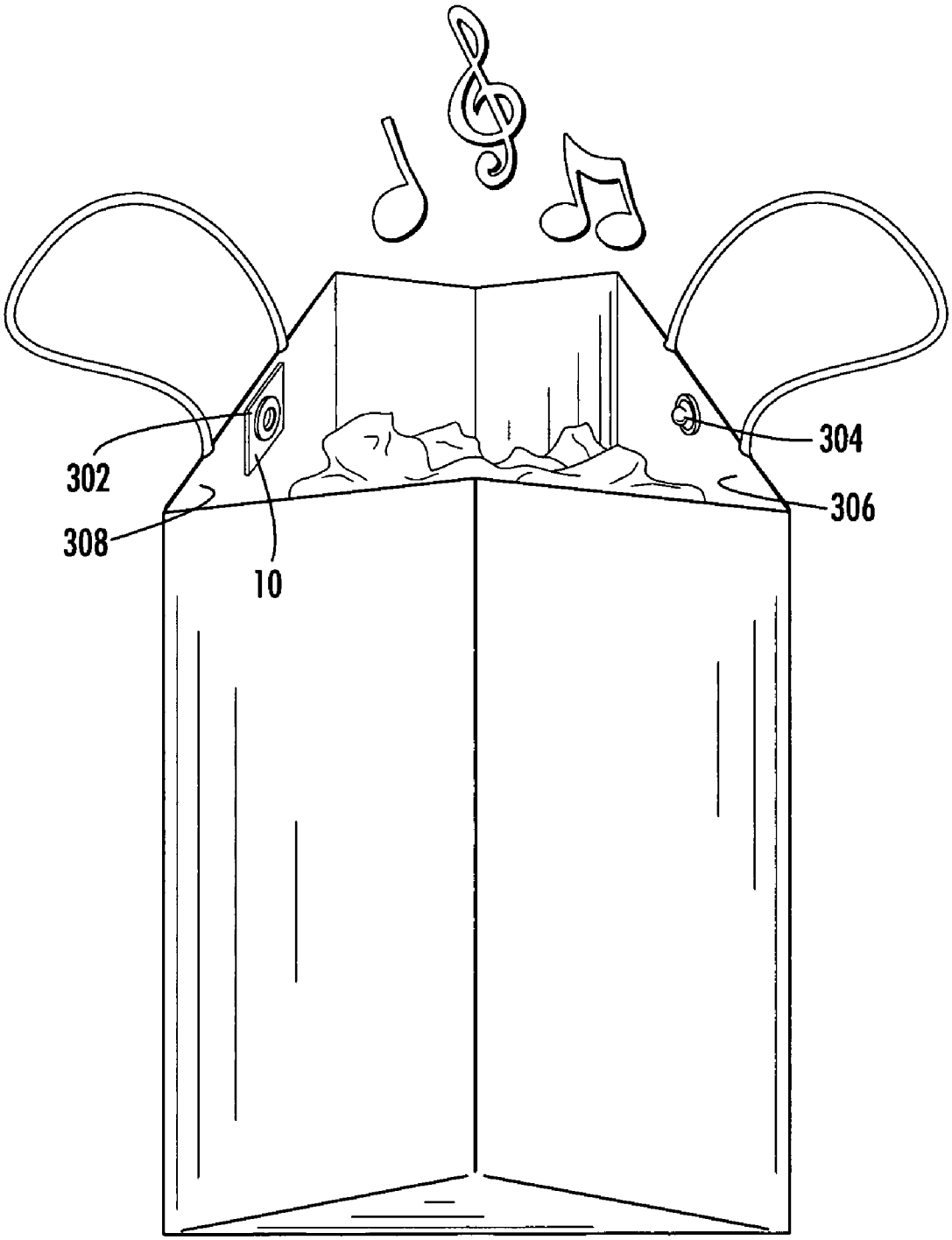
FIG. 12 shows a perspective view of a sound device according to a fourth embodiment in which the module is used with a gift bag.

A sound device 10 according to a fourth embodiment is shown in FIG. 12. The sound device 10 according to this embodiment is the same as the device according to the first through third embodiments, with the exception of the switch. In the fourth embodiment, the switch comprises a snap composed of a female member 302 and a male member 304. The switch is constructed in a well-known way so that when the female member 302 and the male member 304 are separated, a circuit is completed in the sound device 10 and a sound is produced. Moreover, when the female member and the male member are joined, the circuit is interrupted and no sound is produced. Of course, one of ordinary skill will appreciate that the switch can operate in the opposite manner, such that when the female and male members are joined, the circuit is completed.

The sound device according to the fourth embodiment is well suited for use with an envelope having a clasp or a bag constructed of heavy paper and having opposing bag walls 306 and 308 on which opposing members 302 and 309 are respectively mounted. Such paper bags are often distributed by retail stores to hold purchased items. Often, paper bags of this type are decorated and are suitable as gift bags. Of course, the sound device according to the fourth embodiment may be used in conjunction with a variety of containers, including gift boxes, envelopes, bags and even crates.

Figure 13:
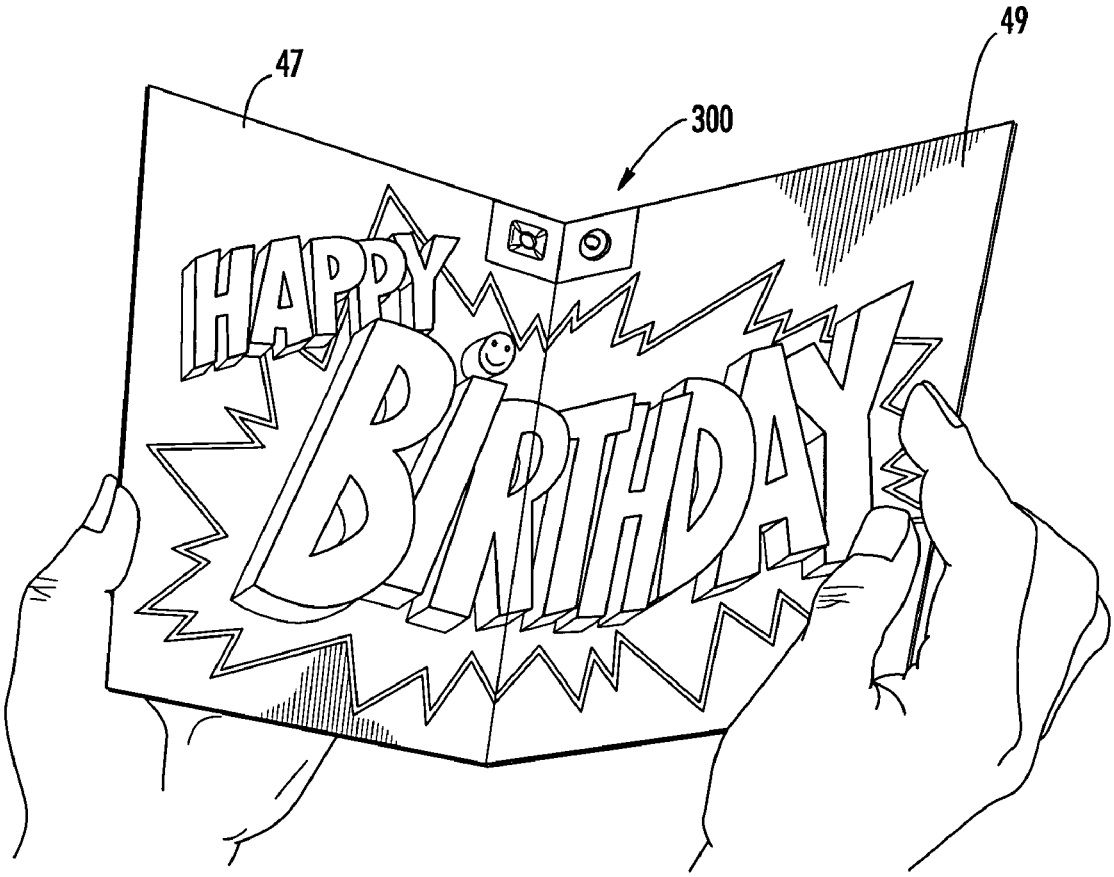
FIGS. 13 through 15 show cards with a snap, magnet or hook and loop fastener, respectively for holding the card in closed position and an attached sound device in the "off" position.
Figure 14:
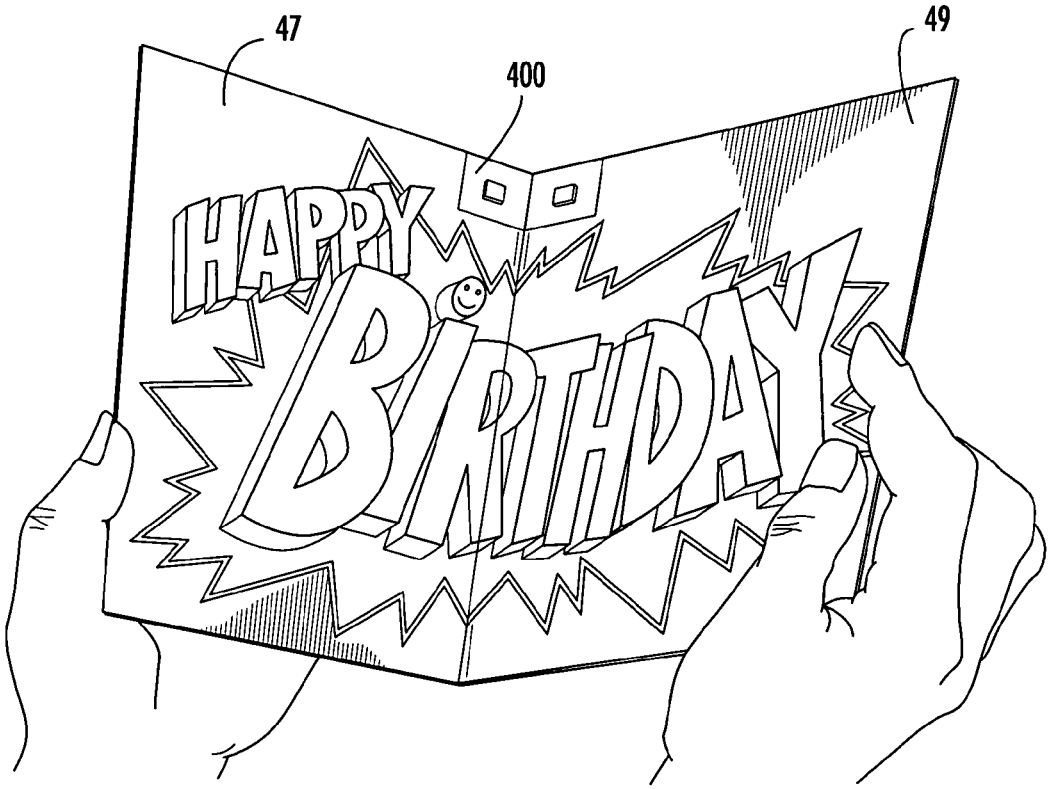
Figure 15:
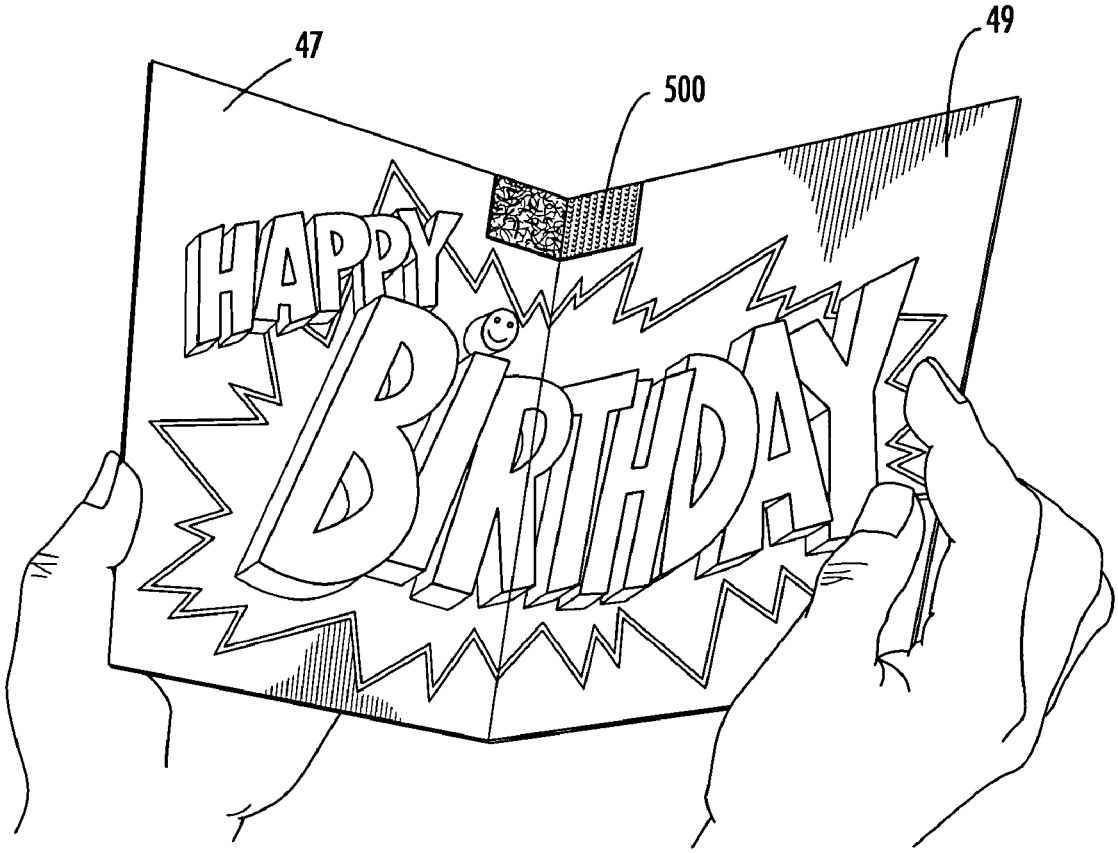

As shown in FIGS. 13 through 15, the sound device according to the present invention may also be used with a card, such as a birthday card, rather than a gift box or gift bag. The sound module shown in FIGS. 1 through 3 is particularly suited for use with a card, because the distal end 16 of the strip 12 can be applied to one flap 47 of the card while the housing 13 can be applied to an opposite flap 49 of the card. When the card is opened, the strip 12 is pulled out of the housing 13, thereby permitting the circuit inside the sound device 10 to be completed and causing sound to be produced.

Although the sound device for use with the cards shown in FIGS. 13 through 15 is preferably the sound device shown in FIGS. 1 through 3, the sound devices according to the other embodiments may also be used with only minor modifications to the switches of those other embodiments. The card having the sound module provided therein may also include a mechanism for holding the two flaps of the card together. Such a mechanism may include a snap 300 shown in FIG. 13, a magnet 400 shown in FIG. 14, or hook and loop fastener 400 shown in FIG. 16.

As will be understood form the description provided above that the device for producing sound can be used with gift boxes, greeting cards, bags and other containers. Accordingly, in this context and for purposes of the present application and the concluding claims, such boxes, cards, bags and the like will be referred to as "packages".

Sound devices according to any of the foregoing embodiments can be marketed as follows: a plurality of such devices can be packaged in the container as shown in FIG. 7. That container may then be offered for sale in any suitable outlet. Thus, a consumer can purchase the container of a number of sound devices according to any one of the foregoing embodiments at that outlet, remove a device from the package and affix the device to a particular gift container or package.

The embodiments discussed above are representative of the present invention and are provided for illustrative purposes only. They are not intended to limit the scope of the invention. Although components, configurations, and means of connecting various parts have been shown and described, such are not limiting. Modifications and variations are contemplated within the scope of the invention, which is intended to be limited only by the scope of the accompanying claims.

What is claimed is:

1. A device for producing sound configured to be selectably mounted by a user on a package, said device comprising:

a package having a first portion and a second portion separate and detached from the first portion, with said first and second portions movable relative to each other from a closed position to an open position;

a power source;

a sound module adapted to produce sound when electrically connected to said power source;

mounting means permitting the user to selectably mount said sound module on said first portion of said package;

a switch electrically interposed between said sound module and said power source and configured to move between a non-conducting position in which said power source is not electrically connected to said sound module and a conducting position in which said power source is electrically connected to said sound module;

a switch actuator linked to said switch to move it from the non-conducting position to the conducting position; and attaching means permitting the user to attach said switch actuator to said second portion of said package, said switch actuator and said mounting means being configured such that when said first and second portions of said package are moved from the closed to the open position said switch moves from its non-conductive to its conducting position, thereby to connect said power source to said sound module and cause said sound module to produce sound; said switch actuator comprising an elongated strip having a distal end including said attaching means, and a proximal end cooperating with said switch, and whereby in said open position said first and second portions are separate and detached such that said strip is remote from said switch and said first portion, and said distal end of said strip remains attached to said second portion.

2. The device for producing sound according to claim 1, wherein said switch comprises a conductive leaf and a conductive plate, and said proximal end of said strip is interposed between said conductive leaf and said conductive plate to place said switch in the non-conducting position.

3. The device for producing sound according to claim 2, wherein said attaching means comprises an adhesive applied to said elongated strip at said distal end remote from said proximal end.

4. The device for producing sound according to claim 3, wherein said elongated strip further comprises a peelable strip for temporarily covering said adhesive.

5. The device for producing sound according to claim 1, wherein said mounting means comprises one of adhesive and a hook-and-loop fastener.

6. A device for producing sound configured to be selectably mounted by a user on a package having first and second separate and detached portions movable relative to each other from a closed position to an open position, said device comprising:

a power source;

a sound module adapted to produce sound when electrically connected to said power source;

means permitting the user to selectably mount said sound module on said first portion of said package;

a switch electrically interposed between said sound module and said power source and configured to move between a non-conducting position in which said power source is not electrically connected to said sound module and a conducting position in which said power source is electrically connected to said sound module;

a switch actuator linked to said switch to move it from the non-conducting position to the conducting position; and means permitting the user to attach said switch actuator to said second portion of said package, said switch actuator and said attaching means being configured such that when said first and second portions of said package are moved from the closed to the open position said switch moves from its non-conductive to its conducting position, thereby to connect said power source to said sound module and cause said sound module to produce sound, wherein said switch comprises a conductive leaf and a conductive plate, and said switch actuator comprises an elongated strip, a proximal end of which is interposed between said conductive leaf and said conductive plate to place said switch in the non-conducting position, wherein said attaching means comprises an adhesive applied to said elongated strip at a distal end remote from said proximal end, and wherein a portion of said elongated strip between said proximal end and said distal end is folded upon itself, whereby said attaching means permits the user to attach the distal end of said strip to said second portion of said package when said sound module is mounted on said first portion of said package.

7. A device for producing sound configured to be selectably mounted by a user on a package, said device comprising:

a package having a first portion and a second portion separate and detached from the said first portion, with the said first and second portions movable relative to each other from a closed position to an open position;

a power source;

a sound module adapted to produce sound when electrically connected to said sound module;

mounting means permitting the user to selectably mount said sound module on one of said first portion and said second portion of said package;

a switch electrically interposed between said sound module and said power source and configured to move between a non-conducting position in which said power source is not electrically connected to said sound module and a conducting position in which said power source is electrically connected to said sound module;

a switch actuator linked to said switch to move it from the non-conducting position to the conducting position; and associating means for permitting the user to associate said switch actuator with the other one of said first portion and second portion of said package, said switch actuator and said mounting means being configured such that when said first and second portions of said package are moved from the closed to the open position said switch moves from its non-conducting to its conducting position, thereby to connect said power source to said sound module and cause said sound module to produce sound; said switch actuator comprising an elongated strip having a distal end including said associating means, and a proximal end cooperating with said switch, and whereby in said open position said first and second portions are separate and detached such that said strip is remote from said switch and said one of said first and second portions, and said distal end of said strip remains associated with said other one of said first and second portions.

8. The device for producing sound according to claim 7, wherein said switch comprises a conductive leaf and a conductive plate, and said proximal end of said strip is interposed between said conductive leaf and said conductive plate to place said switch in the non-conducting position.

9. The device for producing sound according to claim 8, wherein said associating means comprises an adhesive applied to said elongated strip at said distal end remote from said proximal end.

10. The device for producing sound according to claim 9, wherein said elongated strip further comprises a peelable strip for temporarily covering said adhesive.

11. The device for producing sound according to claim 7, wherein said mounting means comprises one of adhesive and a hook-and-loop fastener.

12. A device for producing sound configured to be selectably mounted by a user on a package having first and second separate and detached portions movable relative to each other from a closed position to an open position, said device comprising:

a power source;

a sound module adapted to produce sound when electrically connected to said sound module;

means permitting the user to selectably mount said sound module on one of said first portion and said second portion of said package;

a switch electrically interposed between said sound module and said power source and configured to move between a non-conducting position in which said power source is not electrically connected to said sound module and a conducting position in which said power source is electrically connected to said sound module;

a switch actuator linked to said switch to move it from the non-conducting position to the conducting position; and means for permitting the user to associate said switch actuator with one of said first portion and second portion of said package, said switch actuator and said associating means being configured such that when said first and second portions of said package are moved from the closed to the open position said switch moves from its non-conducting to its conducting position, thereby to connect said power source to said sound module and cause said sound module to produce sound, wherein a portion of said elongated strip between said proximal end and said distal end is folded upon itself, whereby said associating means permits the user to attach the distal end of said strip to said second portion of said container when said sound module is mounted on said first portion of said package.

* * * * *

UNITED STATES PATENT AND TRADEMARK OFFICE

CERTIFICATE OF CORRECTION

PATENT NO. : 7,600,336 B2
APPLICATION NO. : 10/930819
DATED : October 13, 2009
INVENTOR(S) : Terry Hermanson et al.

It is certified that error appears in the above-identified patent and that said Letters Patent is hereby corrected as shown below:

COLUMN 1

Line 15, "child birth" should read --childbirth--.

COLUMN 2

Line 34, "describe" should read --described--; and
Line 35, "means or" should read --means of--.

COLUMN 4

Line 36, "device 10" should read --devices 10--; and
Line 60, "child birth" should read --childbirth,--.

COLUMN 7

Line 9, "form" should read --from--; and "above" should read --above,--;
Line 10, "that" should be deleted; and
Line 60, "said" should read --¶ said--.

COLUMN 8

Line 59, "with the" should read --with--.

COLUMN 9

Line 19, "said" should read --¶ said--.

Signed and Sealed this

Sixteenth Day of February, 2010

David J. Kappos

David J. Kappos
*Director of the United States Patent and Trademark Office*